US012150479B2

(12) United States Patent
Batista et al.

(10) Patent No.: US 12,150,479 B2
(45) Date of Patent: Nov. 26, 2024

(54) ARTICLE FOR FORMING AN AEROSOL

(71) Applicant: PHILIP MORRIS PRODUCTS S.A., Neuchatel (CH)

(72) Inventors: Rui Nuno Batista, Morges (CH); Frederic Nicolas, Moret-Loing-et-Orvanne (FR); Cyrille Poindron, Cruseilles (FR)

(73) Assignee: Philip Morris Products S.A., Neuchatel (CH)

( * ) Notice: Subject to any disclaimer, the term of this patent is extended or adjusted under 35 U.S.C. 154(b) by 884 days.

(21) Appl. No.: 17/262,319

(22) PCT Filed: Jul. 18, 2019

(86) PCT No.: PCT/EP2019/069409
§ 371 (c)(1),
(2) Date: Jan. 22, 2021

(87) PCT Pub. No.: WO2020/020747
PCT Pub. Date: Jan. 30, 2020

(65) Prior Publication Data

US 2021/0289841 A1 Sep. 23, 2021

(30) Foreign Application Priority Data

Jul. 26, 2018 (EP) ..... 18185901

(51) Int. Cl.
*A24F 40/42* (2020.01)
*A24F 40/53* (2020.01)

(52) U.S. Cl.
CPC ..... *A24F 40/42* (2020.01); *A24F 40/53* (2020.01)

(58) Field of Classification Search
CPC ..... A24F 40/42; A24F 40/53
USPC ..... 131/329
See application file for complete search history.

(56) References Cited

U.S. PATENT DOCUMENTS

| | | | | |
|---|---|---|---|---|
| 10,834,964 | B2 | 11/2020 | Monees | |
| 10,881,138 | B2 | 1/2021 | Saleem | |
| 11,224,249 | B2 | 1/2022 | Poget | |
| 11,229,758 | B2 * | 1/2022 | Davidson | A24F 40/42 |
| 2015/0181936 | A1 | 7/2015 | Lyubomirskiy | |
| 2017/0071255 | A1 * | 3/2017 | Revell | H05B 1/0244 |
| 2017/0318862 | A1 | 11/2017 | Mironov | |

(Continued)

FOREIGN PATENT DOCUMENTS

| | | |
|---|---|---|
| JP | 2013-523094 | 6/2013 |
| JP | 2014-076065 | 5/2014 |
| JP | 2015-513922 | 5/2015 |

(Continued)

OTHER PUBLICATIONS

Search Report and Written Opinion for PCT/EP2019/069409 dated Oct. 10, 2019 (9 pages).

(Continued)

*Primary Examiner* — Gary F Paumen
(74) *Attorney, Agent, or Firm* — Mueting Raasch Group

(57) ABSTRACT

An article (1) for forming an aerosol. The article (1) is insertable, in use, into a heating chamber of a device for generating an aerosol. The article (1) comprises an aerosol-forming substrate (2) and volume limiting means (3). The volume limiting means (3) is activated or activatable by a device for generating an aerosol to limit the volume of the article (1).

13 Claims, 4 Drawing Sheets

(56) References Cited

U.S. PATENT DOCUMENTS

2019/0014820 A1* 1/2019 Malgat ..... A24D 1/22

FOREIGN PATENT DOCUMENTS

| | | | |
|---|---|---|---|
| WO | WO 2008/029381 | 3/2008 | |
| WO | WO 2017/045899 | 3/2017 | |
| WO | WO 2017/068094 | 4/2017 | |
| WO | WO 2017/114760 | 7/2017 | |
| WO | WO 2017/122196 | 7/2017 | |
| WO | WO-2017115196 A1 * | 7/2017 | ..... A24D 1/22 |

OTHER PUBLICATIONS

Extended European Search Report for Application No. 18185901.8 dated Jan. 21, 2019 (7 pages).
Office Action issued in Japan for Application No. 2021-500879 dated May 26, 2023 (4 pages). English translation included.
Office Action issued in Japan for Application No. 2021-500879 dated May 21, 2024 (4 pages). English translation included.

* cited by examiner

ARTICLE FOR FORMING AN AEROSOL

This application is a U.S. National Stage Application of International Application No. PCT/EP2019/069409 filed Jul. 18, 2019, which was published in English on Jan. 30, 2020 as International Publication No. WO 2020/020747 A1. International Application No. PCT/EP2019/069409 claims priority to European Application No. 18185901.8 filed Jul. 26, 2018.

This invention relates generally to an article for forming an aerosol and to a method of using such an article.

A number of devices for generating an aerosol have been proposed in the art. For example, devices for generating aerosols which heat rather than combust an aerosol-forming substrate have been proposed. Heated smoking devices in which tobacco is heated rather than combusted, are one type of such devices. An aim of such smoking devices is to reduce the generation of unwanted and harmful smoke constituents of the type produced by the combustion and pyrolytic degradation of tobacco in conventional cigarettes. These heated smoking devices are commonly known as 'heat not burn' devices.

Heated smoking devices of the above-described type commonly comprise a heating chamber, provided with, e.g. defined by, heating surfaces, into which an article 1' for forming an aerosol (as shown in FIG. 1) is inserted, prior to use. The article 1' for forming an aerosol typically contains an aerosol-forming substrate 2' which is heated by a heater of the device to generate an aerosol. When the aerosol-forming substrate 2' contained in an article 1' has been exhausted the article 1' can be replaced. The heated smoking device thereby constitutes a reusable device whilst the article 1' comprises a 'consumable' product. The articles 1' for forming an aerosol are generally shaped and sized to mimic conventional cigarettes. Accordingly, the articles 1', and the heating chamber in the heated smoking device into which they are inserted or insertable, typically have a generally cylindrical shape (where the shape of such an article 1' can be seen in FIG. 1). Typically, the diameter of the articles 1' is from 5 to 10 mm, say about 7.2 mm.

Articles 1' for forming an aerosol of the above-described type typically have a wrapper or carrier layer within which the aerosol-forming substrate 2' is retained. Filter material may be provided at one or both of the ends of the article 1', serving as a plug to retain the aerosol-forming substrate 2' within the article 1' and, also, to filter aerosol generated by the heated smoking device, in use. Additionally, an aerosol-cooling element (which may be formed from a gathered sheet of polylactic acid, for example) may be located within the article 1', between the aerosol-forming substrate 2' and the filter at one end of the article 1'. A support element (for example formed from a hollow acetate tube) may additionally be positioned between the aerosol-forming substrate 2' and the aerosol-cooling element.

In use, a user inserts an article 1' between heating surfaces of a heating chamber of a heated smoking device. The user then draws air through a free end of the article 1' (said free end typically comprising filter material). The heater within the heated smoking device is activated to transfer thermal energy to the article 1' for forming an aerosol, thereby releasing volatile compounds from the aerosol-forming substrate 2'. The air flows through at least part of the device and then along at least a part of the length of the article 1', passing through the aerosol-forming substrate 2' and drawing released volatile compounds therefrom along with it. The airflow and volatile compound mixture then passes through the cooling segment, where the volatile compounds cool and condense into an aerosol. This aerosol then passes through the filter material before being drawn into the lungs of the user. The wrapper or carrier layer acts as a baffle during this process and serves to direct the air flow causing it to flow through and along the article 1' to the user.

After use, the article 1' for forming an aerosol is preferably removed from the heating chamber of the heated smoking device. As will be appreciated, however, the article 1' for forming an aerosol is typically altered by heating thereof. For example, the article 1' may have a first volume and/or shape $V_1$ (as shown in FIG. 2), prior to heating in the heating chamber, and the article 1" may have a second volume and/or shape $V_2$ (for example, as shown in FIG. 3) subsequent to heating thereof in the heating chamber. In particular, the article 1' may have a first diameter $d_1$ prior to heating in the heating chamber and a second, greater diameter $d_2$, subsequent to heating (and/or during heating) in the heating chamber. The application of heat to the article 1' may cause the article 1' to expand from the first volume $V_1$ to the, relatively increased, second volume $V_2$. Additionally or alternatively, heating of the article 1' may cause or result in a chemical reaction. The article 1" may, therefore, be in a state of at least partial interference with one or more inner surfaces of the heating chamber. For example, the article 1" may press against one or more inner surfaces of the heating chamber, after heating therein, with a relatively greater force than that exerted upon initial insertion and prior to heating of the article 1' for forming an aerosol. Where a chemical change is caused in the article 1" it may at least partially adhere to an inner surface of the heating chamber.

These changes to the article for forming an aerosol caused by heating commonly result in increased difficulty in removing such an article 1" from the heating chamber, after use. In extreme cases removal of the article 1" from the heating chamber of the device may not be possible or may prove overly challenging, in which case the heated smoking device may be disposed of, resulting in a need for a replacement device (with accompanying material costs and negative environmental impact). In less extreme cases, although the article 1" may still be removed from the heating chamber of the device, this removal may prove to be a time consuming and/or tricky process and, therefore, user enjoyment of the device may be relatively diminished. Furthermore, one or more portions of the article 1" may be retained within the heating chamber of the device even after substantive removal therefrom, thereby reducing the efficiency of heating replacement articles 1' for forming an aerosol inserted into the heating chamber.

It would be desirable to provide an article for forming an aerosol which is improved over prior art articles for forming an aerosol. It would be desirable to provide an article for forming an aerosol which mitigates one or more of the above-identified issues. It would be desirable to provide an article for forming an aerosol which can be more readily and/or rapidly removed from the heating chamber of a device for generating an aerosol after heating therein. It would also be desirable to provide an improved method of using an article for forming an aerosol, with one or more of the above-identified advantages.

Accordingly, an aspect of the invention provides an article for forming an aerosol, the article being insertable, in use, into a heating chamber of a device for generating an aerosol, the article comprising an aerosol-forming substrate and volume limiting means, the volume limiting means being activated or activatable by a device for generating an aerosol to limit the volume of the article.

Advantageously, the volume limiting means of articles for forming an aerosol according to the invention improves the removability of such articles from the heating chamber of a device for generating an aerosol, after use thereof therein. By limiting the expansion of such articles, during use, the force required to remove the article from the heating chamber after use therein is relatively reduced and, therefore, removal therefrom is relatively easier. Additionally, by limiting expansion of the article, during use, articles according to the invention are beneficially less prone to becoming at least partially adhered to the inner walls of the heating chamber. Articles according to the invention are therefore more user-friendly than are prior art articles for forming an aerosol. Moreover, the efficiency of heating articles according to the invention is relatively increased, due to a decrease in the likelihood of articles breaking while they are being removed from the heating chamber. The heating of subsequently inserted new, replacement articles in the heating chamber are therefore less likely to be effected by broken portions of used articles which might otherwise remain in the heating chamber between uses of the device.

As used herein, the phrase 'aerosol-forming substrate' is used to describe a substrate capable of releasing upon heating volatile compounds, which can form an aerosol. The aerosol generated from aerosol-forming substrates described herein may be visible or invisible to the human eye. The aerosol-forming substrate may comprise a solid, a fluid or a mixture of solid and fluid substrate. Where the aerosol-forming substrate is a fluid it is advantageously retained within a matrix and/or by a cover layer, at least prior to receipt of the aerosol-forming substrate in the heating chamber.

As used herein, the term 'aerosol' is used to describe a suspension of relatively small particles in a fluid medium.

As used herein, the phrase 'volume limiting means' is used to describe a means by which the volume of the article is limited relative to a potential volume thereof (absent the volume limiting means). For example, the volume of the article may be expanded or expandable (e.g. upon heating thereof) and the volume limiting means may be arranged and/or configured to limit such expansion.

As used herein, the phrase 'activated or activatable' is used to mean that the volume limiting means is changed or changeable from a first state to a second state, for example where in the second state the volume limiting mean comprises an enhanced ability to limit the volume of the article.

In some embodiments, the volume limiting means may be activated or activatable by irradiation with electromagnetic radiation, for example from and/or generated by the device for generating an aerosol. The electromagnetic radiation may comprise infrared radiation, for example heating. In embodiments, the volume limiting means may be activated or activatable by application thereto of electrical energy, for example from the device for generating an aerosol. In embodiments, the volume limiting means may be activated or activatable by contact with one or more substances from the device for generating an aerosol, for example configured or selected to cause a chemical reaction in or of the volume limiting means to thereby limit the volume of the article.

Where the volume limiting means is activated or activatable by irradiation with heating the activation may occur at a threshold temperature and/or when a threshold amount of thermal energy has been supplied to or received by the article and/or the volume limiting means. The threshold temperature may correspond to or be equal to a normal heating temperature of the article, Alternatively, the threshold temperature may correspond to a volume limiting temperature, for example which may be greater than a normal heating temperature of the article, for example a temperature to which the article is heated to generate aerosol-forming substrate (e.g. during normal heating in a heating chamber of a device for generating an aerosol). In some embodiments the aerosol-forming substrate may be selected or configured to release volatile compounds (for example to begin releasing volatile compounds) at a first temperature. The volume limiting means may be selected or configured to be activated or activatable at a second temperature. The first temperature may be the same as the second temperature. Alternatively, the second temperature may be greater than the first temperature. The first temperature may be less than 400 degrees centigrade, for example less than 300 degrees centigrade, say less than 270 degrees centigrade. In embodiments, the first temperature may be less than 250, 225, 200, 175 or 150 degrees centigrade, for example less than 140, 130, 120, 110, 100 or 90 degrees centigrade.

The article may have a first volume, prior to activation of the volume limiting means, for example and activation of the volume limiting means may limit the article to a second volume. In embodiments, the second volume may be greater than the first volume, for example activation of the volume limiting means may limit or prevent the article expanding beyond the second volume. The second volume may be substantially equal to the first volume. Alternatively, the second volume may be less than the first volume. The volume limiting means may comprise a volume restricting means. In some embodiments, the volume limiting means may comprise at least a peripheral portion of the article. In embodiments, the volume limiting means may be at least partially surrounded by aerosol-forming substrate. In embodiments, the volume limiting means may comprise at least one cavity or aperture in the article (for example in the aerosol-forming substrate). In some embodiments, the aerosol-forming substrate may comprise the volume limiting means. The volume limiting means may comprise a heat activated or activatable compound. The volume limiting means may comprise one or more shape memory elements, for example which may be activated or activatable to return or move to or toward a second shape or volume from a first shape or volume.

The volume limiting means may comprise thermoset plastics, for example to limit but not reduce the volume of the article. The volume limiting means may comprise heat shrink plastics, for example thermoplastics materials, such as polyolefin, fluorinated ethylene propylene, polytetrafluoroethylene, polyvinyl chloride, polychloroprene, silicone, elastomers and the like.

Preferably, the aerosol-forming substrate comprises nicotine. The aerosol-forming substrate may comprise tobacco. Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets (e.g. containing one or more of: herb leaf, tobacco leaf, tobacco ribs, expanded tobacco and homogenised tobacco).

Optionally, the solid aerosol-forming substrate may contain tobacco or non-tobacco volatile flavour compounds, which are released upon heating of the solid aerosol-forming substrate.

If the aerosol-forming substrate is in the form of a fluid, for example a liquid or a gas, the aerosol-forming substrate may contain tobacco or non-tobacco volatile flavour compounds, which are released upon heating of the fluid aerosol-forming substrate.

Optionally, the solid or fluid aerosol-forming substrate may be provided on or embedded in a carrier material, for example a thermally stable carrier material. The carrier material may take the form of a foam, e.g. an open or closed cell foam. The solid or fluid aerosol-forming substrate may be deposited throughout the carrier material, e.g. throughout the volume thereof. Additionally or alternatively, the solid or fluid aerosol-forming substrate may be deposited on the surface of the carrier material in the form of, for example, a sheet, foam, gel or slurry. The solid or fluid aerosol-forming substrate may be deposited on the entire surface of the carrier material, or alternatively, may be deposited in a pattern in order to provide a non-uniform flavour delivery during use. The carrier material may comprise the volume limiting means.

In some embodiments, the article (for example the aerosol-forming substrate) may comprise a matrix material, for example a foam. The foam may be open celled or closed celled. The foam may be a reticulated open celled foam. The foam may be at least partially formed from tobacco, for example from reconstituted tobacco (e.g. stems and the like). The article (for example the aerosol-forming substrate) may be at least partially formed from a resilient material. The resilient material may comprise the matrix material, for example the foam. The volume limiting means may comprise the matrix material, for example the foam. The volume limiting means may comprise the resilient material.

In some embodiments, the article may comprise one or more metal elements (for example susceptors). The, one, some or each of the one or more metal elements may be located in and/or on the article (for example the aerosol-forming substrate). The, one, some or each of the one or more metal elements may be located in and/or on the first and/or second region of the aerosol-forming substrate. Said one or more metal elements may extend at least partially along the length of the article (where the article has a length). Said one or more metal elements may extend across at least partially across the width of the article (where the article has a width). Said one or more metal elements may extend through the thickness of the article (where the article has a thickness). Said one or more metal elements may have any suitable shape, for example: a loop, a coil, a strip, a sphere, a strand, a particle, irregular shaped and the like. Said one or more metal elements may comprise a metallic shell or cover layer of any suitable shape (for example as described above) surrounding a non-metallic material and/or which may be hollow.

In some embodiments, the article may comprise a cover layer and/or wrapper. The cover layer and/or wrapper may extend about the external surfaces of the article, for example may circumscribe the periphery of the aerosol-forming substrate. The cover layer and/or wrapper may be formed from a polymer such as a food grade plastic and/or a paper such as filter paper. Additionally or alternatively, the cover layer and/or wrapper may comprise any other suitable material, for example abaca fibres and the like. The cover layer may comprise cellulose. The cover layer and/or wrapper may comprise and/or be at least partially formed from tobacco, for example reconstituted tobacco. The cover layer and/or wrapper may comprise plural apertures through its thickness, for example where the plural apertures may be arranged uniformly or randomly. The cover layer and/or wrapper may comprise a net or mesh or weave. Alternatively, the cover layer and/or wrapper may comprise a solid surface, for example having a region (e.g. a major region) absent plural apertures through its thickness. In embodiments, the volume limiting means may comprise a or the cover layer and/or wrapper of the article (for example at least a part of a or the cover layer and/or wrapper of the article).

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-forming substrate. Suitable aerosol formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

The article for forming an aerosol may comprise a volatile flavour-generating component. The aerosol forming substrate (for example and/or the carrier material, where provided) may comprise the volatile flavour-generating component. The volatile flavour-generating component may be at least partially retained in and/or impregnated into and/or located on the surface of the aerosol-forming substrate and/or a carrier material (if such is provided) and/or the cover layer (where provided) and/or the peripheral mould surface thereof.

As used herein the term 'volatile flavour-generating component' is used to describe any volatile component that is added to an aerosol-forming substrate (for example and/or carrier material, where provided) in order to provide a flavourant.

Suitable flavourants include, but are not limited to, materials that contain natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole, linalool, and the like.

As used herein, the term 'menthol' is used to describe the compound 2-isopropyl-5-methylcyclohexanol in any of its isomeric forms.

Menthol may be used in solid or liquid form. In solid form, menthol may be provided as particles or granules. The term 'solid menthol particles' may be used to describe any granular or particulate solid material comprising at least approximately 80% menthol by weight.

Preferably, 1.5 mg or more of the volatile flavour-generating component is included in the aerosol-forming substrate.

The volatile flavour-generating component (where provided) may be in the form of a liquid or a solid. The volatile flavour-generating component may be coupled to, or otherwise associated with, a support element. The support element may comprise any suitable substrate or support for locating, holding, or retaining the volatile flavour-generating component. For example, the support element may comprise a fibrous support element, which may be saturated or saturatable with fluid, for example a liquid.

In embodiments, the volatile flavour-generating component may have any suitable structure in which a structural material releasably encloses a flavourant or flavourants. For example, in some preferred embodiments, the volatile flavour-generating component comprises a matrix structure defining a plurality of domains, the flavourant being trapped within the domains until released, for example, when the aerosol-forming substrate is subject to external force. Alternatively, the volatile flavour-generating component may comprise a capsule. Preferably, the capsule comprises an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule.

If the volatile flavour-generating component comprises a matrix structure defining a plurality of domains enclosing the flavourant, the flavourant delivery member may release the flavourant steadily when the aerosol-forming substrate is subject to external force. Alternatively, if the volatile flavour-generating component is a capsule arranged to rupture or burst to release the flavourant when the article for forming an aerosol is subject to external force (for example, but not limited to, if the capsule comprises an outer shell and an inner core), the capsule may have any desired burst strength. The burst strength is the force (exerted on the capsule from the outside of the aerosol-forming substrate) at which the capsule will burst. The burst strength may be a peak in the capsule's force versus compression curve.

The volatile flavour-generating component may be configured to release the flavourant in response to an activation mechanism. Such an activation mechanism may include the application of a force to the volatile flavour-generating component, a change in temperature in the volatile flavour-generating component, a chemical reaction, or any combination thereof.

The resistance to draw (RTD) of the article for forming an aerosol (when inserted into a heating chamber of a device for generating an aerosol) may be between approximately 80 mmWG and approximately 140 mmWG. As used herein, resistance to draw is expressed with the units of pressure 'mmWG' or 'mm of water gauge' and is measured in accordance with ISO 6565:2002.

In some embodiments, the article and/or the aerosol-forming substrate may have a substantially cylindrical shape. The article and/or the aerosol-forming substrate may have a diameter (for example in cross-section) and a length (e.g. a longitudinal dimension).

The article for forming an aerosol and/or the aerosol-forming substrate may have a diameter of at least 5 mm, for example a diameter of between approximately 5 mm and approximately 12 mm, say of between approximately 5 mm and approximately 10 mm or of between approximately 6 mm and approximately 8 mm. In an embodiment, the article for forming an aerosol and/or the aerosol-forming substrate may have an external diameter of 7.2 mm+/−10%.

The article for forming an aerosol and/or the aerosol-forming may have a length of between approximately 30 mm and approximately 100 mm, say approximately 45 mm. In embodiments, the article for forming an aerosol and/or the aerosol-forming substrate may have a length of between approximately 70 mm and 120 mm.

As used herein, the term 'diameter' is used to describe the maximum dimension in the transverse direction of the article for forming an aerosol. As used herein, the term 'length' is used to describe the maximum dimension in the longitudinal direction of the article for forming an aerosol. As used herein, the term 'longitudinal' is used to describe the direction between ends (e.g. upstream and downstream ends) of the article for forming an aerosol and the term 'transverse' is used to describe the direction perpendicular to the longitudinal direction. As used herein, the terms 'upstream' and 'downstream' are used to describe the relative positions of elements, or portions of elements, of the article for forming an aerosol in relation to the direction in which a user draws fluid through the article during use thereof.

In some embodiments, the article and/or the aerosol-forming substrate may have a first major surface which is substantially flat. The article and/or the aerosol-forming substrate may have a second major surface which is substantially flat. The first and second major surfaces may be substantially parallel to one another. The article and/or the aerosol-forming substrate may have a substantially parallelepiped shape. The article and/or the aerosol-forming substrate may have a width, a length and a thickness, for example where the width, length and thickness are measured in a direction perpendicular to one another. The thickness may comprise the distance between the first and second major surfaces, where provided. The width and/or length of the article and/or the aerosol-forming may have a ratio to the thickness of at least 2:1, for example at least 3:1, 4:1, 5:1, 6:1, 7:1, 8:1, 9:1 or 10:1. The width and/or the length of the article and/or the aerosol-forming substrate may be between approximately 2 mm and 120 mm, for example between approximately 3, 4, 5, 6, 7, 8, 9, 10 and 11, 12, 13, 14, 15, 16, 17, 18, 19, 20, 25, 30, 35, 40, 45, 50, 55, 60, 65, 70, 75, 80, 85, 90, 95, 100, 105, 110, 115, 120 mm. The thickness of the article and/or the aerosol-forming substrate may be between approximately 0.5 mm and 15 mm, for example between approximately 0.5 or 1.0 mm and 1.5, 2.0, 2.5, 3.0, 3.5, 4.0, 4.5, 5.0, 6.0, 7.0, 8.0, 9.0, 10.0, 11.0 or 12.0 mm.

The volume limiting means may comprise a volume limiter. The volume limiting means may be activated or activatable to limit the length, width, thickness and/or diameter (where provided) of the article.

According to an aspect of the invention, there is provided a method of using an article for forming an aerosol, the method comprising: providing an article comprising an aerosol-forming substrate and a volume limiting means; inserting the article into a heating chamber of a device for generating an aerosol; and activating the volume limiting means using the device for generating an aerosol to thereby limit the volume of the article.

Activating the volume limiting means may comprise irradiating the volume limiting means with electromagnetic radiation to activate it and thereby limit the volume of the article. Irradiating the volume limiting means with electromagnetic radiation may comprise irradiating the volume limiting means with infra-red radiation, e.g. by heating. Additionally or alternatively, irradiating the volume limiting means with electromagnetic radiation may comprise irradiating the volume limiting means with a magnetic field. Activating the volume limiting means may comprise applying electrical energy to the volume limiting means, for example electrical energy from the device for generating an aerosol. Activating the volume limiting means may comprise contacting the volume limiting means with one or more substances, for example from the device for generating an aerosol.

Activating the volume limiting means may activate or cause the volume limiting means to substantially maintain a starting volume of the article (for example a volume of the article prior to insertion into the heating chamber of the device and/or a volume of the article prior to irradiation thereof). Irradiating the volume limiting means may activate or cause the volume limiting means to reduce or shrink the volume of the article, for example to reduce the volume of the article from the volume of the article prior to insertion into the heating chamber of the device and/or to reduce the volume of the article from the volume of the article prior to irradiation thereof.

All scientific and technical terms used herein have meanings commonly used in the art unless otherwise specified. The definitions provided herein are to facilitate understanding of certain terms used frequently herein.

Throughout the description and claims of this specification, the words "comprise" and "comprising" and variations of them mean "including but not limited to", and they are not intended to (and do not) exclude other moieties, additives, components, integers or steps. Throughout the description and claims of this specification, the singular encompasses the plural, and vice versa, unless the context otherwise requires. In particular, where the indefinite article is used, the specification is to be understood as contemplating plurality as well as singularity, unless the context requires otherwise.

For the avoidance of doubt, any of the features described herein apply equally to any aspect of the invention. Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one aspect or embodiment of the invention are applicable to all aspects or embodiments, unless such features are incompatible.

The invention will now be further described, by way of example only, with reference to the accompanying drawings, in which.

Figure 1:
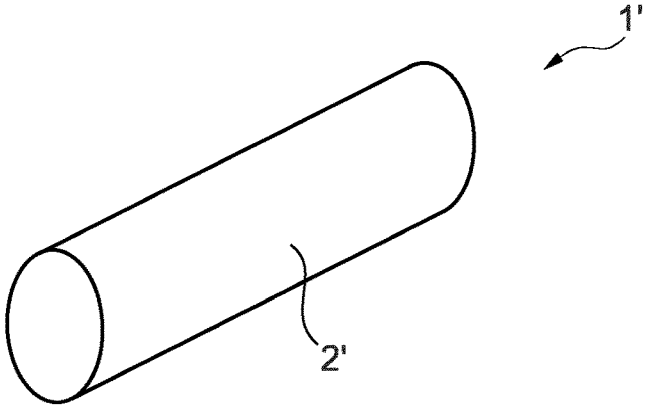
[Prior art] Fig. 1
FIG. 1 is a perspective view of a prior art article for forming an aerosol, prior to heating of the article.
Figure 2:
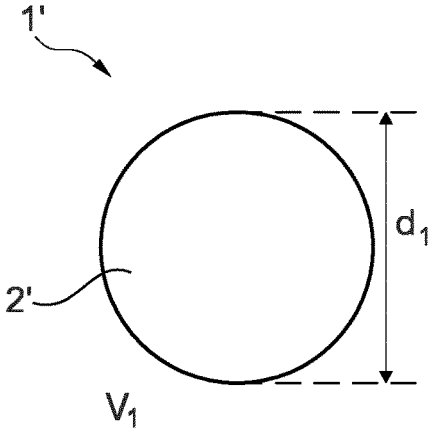
[Prior art] Fig. 2
FIG. 2 is a cross-sectional view of the article shown in FIG. 1 taken along line A-A.
Figure 3:
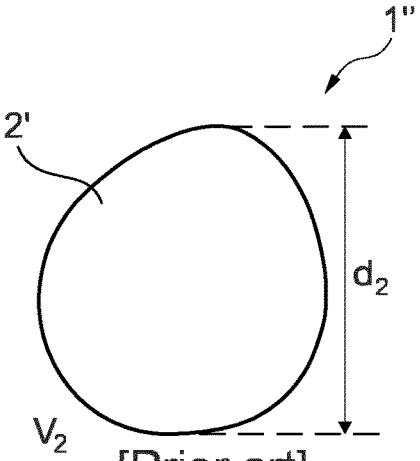
[Prior art] Fig. 3
FIG. 3 is a cross-sectional view of the article shown in FIG. 1 subsequent to heating of the article.
Figure 4:
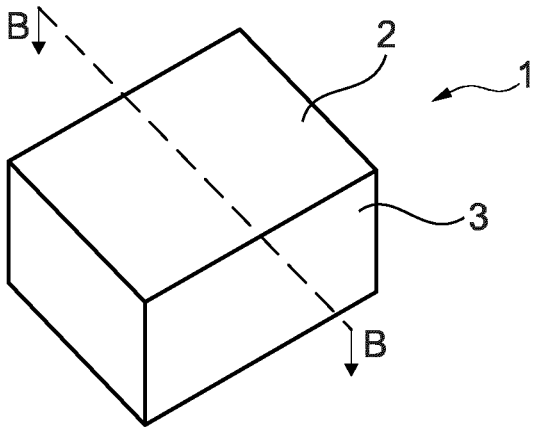
FIG. 4 is a perspective view of an article for forming aerosol according to an embodiment of the invention, prior to use of the article in a device for generating an aerosol.
Figure 5:
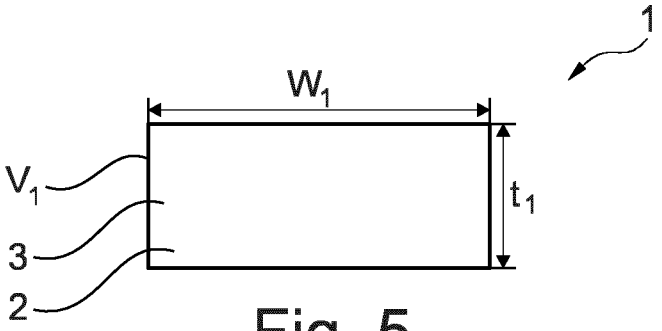
FIG. 5 is a cross-sectional view of the article shown in FIG. 4 taken along line B-B.

Referring now to FIGS. 4 and 5 there is shown an article 1 for forming an aerosol according to an embodiment of the invention. The article 1 comprises aerosol-forming substrate 2 and a foam carrier material which comprises volume limiting means 3, in this embodiment. The aerosol-forming substrate 2 comprises a powder which is deposited throughout the foam carrier material of the volume limiting means 3, in this embodiment. The aerosol-forming substrate 2 comprises reconstituted tobacco, in this embodiment.

Figure 6:
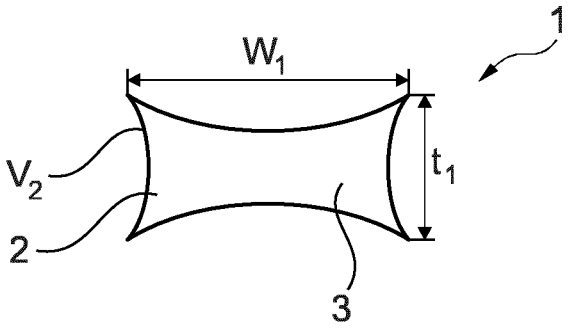
FIG. 6 is a cross-sectional view of the article shown in FIG. 4 subsequent to use of the article in a device for generating an aerosol.

In use, the article 1 is inserted into a heating chamber (not shown) of a device (not shown) for generating an aerosol. The article 1 has a first volume $V_1$ at this time, as shown in FIG. 5. In particular, the article 1 has a first width $w_1$ and thickness $t_1$. The article 1 is then heated to a temperature T1 to generate aerosol from the aerosol-forming substrate 2. Heating of the article 1 irradiates the volume limiting means 3 with infra-red radiation, thereby activating it at temperature T1. Activation of the volume limiting means 3 causes the volume limiting means to reduce the article's 1 volume from the first volume $V_1$ to a second volume $V_2$, as shown in FIG. 6. At the second volume $V_2$, the article 1 has a second width $w_1$ (which is less than the first width $w_1$) and a second thickness $t_2$ (which is less than the first thickness $t_1$).

Advantageously, the article 1 may therefore be more easily removed from the heating chamber of the device for generating an aerosol after heating therein.

Figure 7:
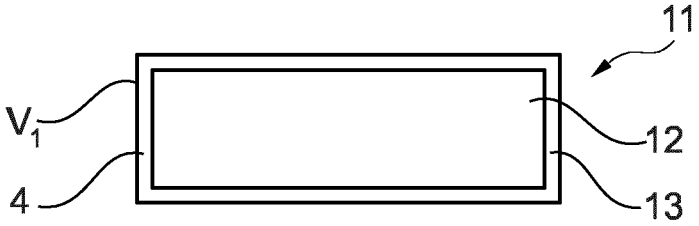
FIG. 7 is a cross-sectional view of an article for forming aerosol according to a further embodiment of the invention, prior to use of the article in a device for generating an aerosol.
Figure 8:
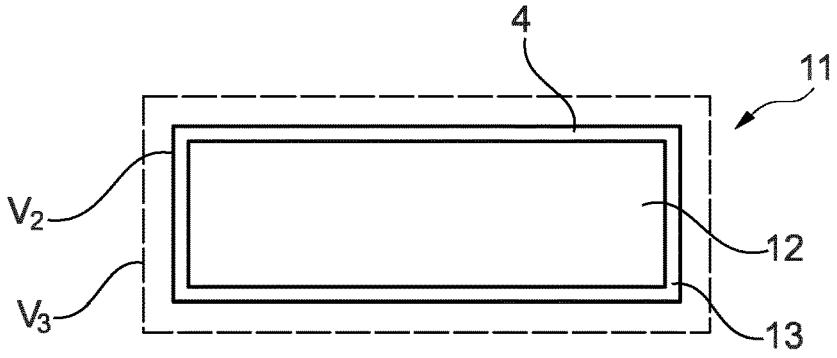
FIG. 8 is a cross-sectional view of the article shown in FIG. 8, subsequent to use of the article in a device for generating an aerosol.

Referring now to FIGS. 7 and 8, there is shown an article 11 for forming an aerosol according to a further embodiment of the invention in which like features to those described in respect of the article 1 shown in FIG. 4 are denoted by like references preceded by a '1' and will not be described further herein. The article 11 differs from that shown in FIG. 4 in that it comprises a cover layer 4 which comprises the volume limiting means 13. The aerosol-forming substrate 12 comprises a reticulated open-celled foam of tobacco, in this embodiment. The periphery of the aerosol-forming substrate 12 is circumscribed by the cover layer 4.

In use, the article 11 is inserted into a heating chamber (not shown) of a device (not shown) for generating an aerosol. The article 11 has a first volume $V_1$ at this time, as shown in FIG. 7. The article 11 is then heated to generate aerosol from the aerosol-forming substrate 12. Heating of the article 11 irradiates the volume limiting means 13 in the cover layer 4 with infra-red radiation, thereby activating it. Activation of the volume limiting means 13 causes the volume limiting means 13 to limit expansion of the articles 11 volume from the first volume $V_1$ to a second volume $V_2$ (as shown in FIG. 8). As shown by the dashed line in FIG. 8, an article for forming an aerosol absent the volume limiting means 13 (all other features being the same) would expand to a third volume $V_3$. Accordingly, the volume limiting means 13 limits expansion of the article 11 upon heating thereof.

Figure 9:
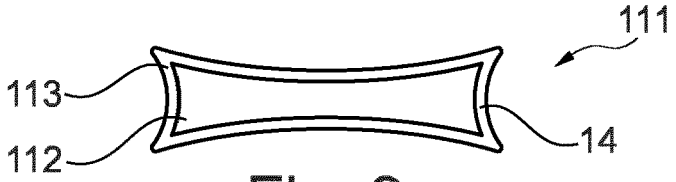
FIG. 9 is a cross-sectional view of an article for forming aerosol according to a further embodiment of the invention, subsequent to use of the article in a device for generating an aerosol.

Referring now to FIG. 9, there is shown an article 111 for forming an aerosol according to an alternative embodiment of the invention in which like features to those described in respect of the article 11 shown in FIGS. 7 and 8 are denoted by like references preceded by a '1' and will not be described further herein. The article 111 shown in FIG. 9 is in a post-use condition or state, for example subsequent to irradiation by infra-red radiation. The article 111 shown in FIG. 9 differs from that shown in FIGS. 7 and 8 in that the volume limiting means 113 is configured, upon activation, to reduce the volume of the article 111 from its starting volume (or from a volume of the article 111 prior to activation of the volume limiting means 113).

Figure 10:
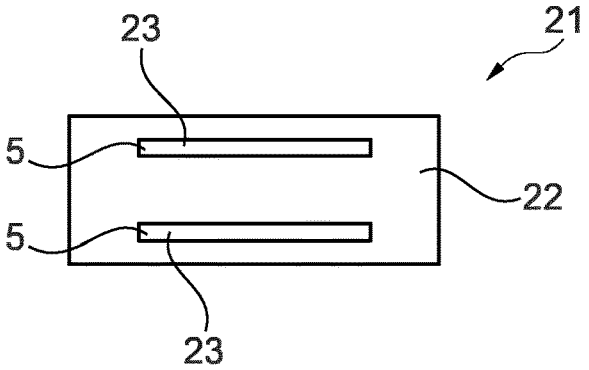
FIG. 10 is a cross-sectional view of an article for forming aerosol according to a further embodiment of the invention, prior to use of the article in a device for generating an aerosol.
Figure 11:
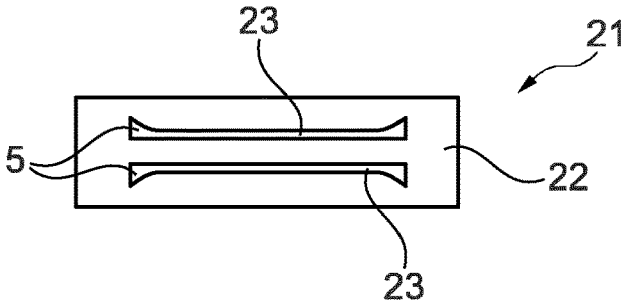
FIG. 11 is a cross-sectional view of the article shown in FIG. 10 subsequent to use of the article in a device for generating an aerosol.

Referring now to FIGS. 10 and 11, there is shown an article 21 for forming an aerosol according to a further embodiment of the invention in which like features to those described in respect of the article 1 shown in FIG. 4 are denoted by like references preceded by a '2' and will not be described further herein. The article 21 differs from that shown in FIG. 4 in that the carrier material comprises internal cavities 5 which comprise the volume limiting means 23. Irradiation of the article by infra-red radiation causes the carrier material and/or the aerosol-forming substrate 22 to expand. However, at least a portion of the expansion of the carrier material and/or the aerosol-forming substrate 22 expands into the internal cavities 5. Accordingly, the internal cavities 5 act to relatively reduce the amount by which the article's 21 volume increases when irradiated with infra-red radiation.

Figure 12:
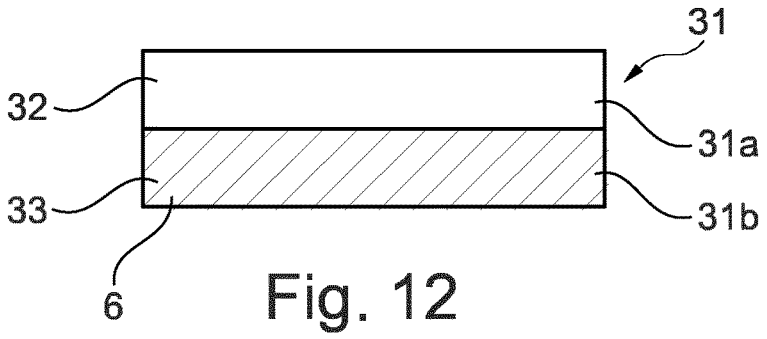
FIG. 12 is a cross-sectional view of an article for forming aerosol according to a further embodiment of the invention, prior to use of the article in a device for generating an aerosol.
Figure 13:
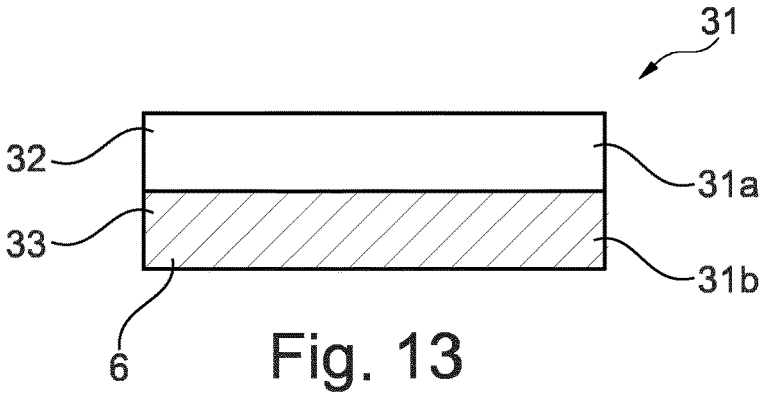
FIG. 13 is a cross-sectional view of the article shown in FIG. 12 subsequent to use of the article in a device for generating an aerosol.

Referring now to FIGS. 12 and 13, there is shown an article 31 for forming an aerosol according to a further embodiment of the invention in which like features to those described in respect of the article 1 shown in FIG. 4 are denoted by like references preceded by a '3' and will not be described further herein. The article 31 differs from that shown in FIG. 4 in that the article comprises first and second portions 31*a*, 31*b*, the first portion 31*a* comprising the aerosol-forming substrate 32 and the carrier material and the second portion 31*b* comprising a volume limiting element 6 comprising the volume limiting means 33. The second portion 31*b* is absent aerosol-forming substrate 32 in this embodiment. However, in embodiments, the second portion may comprise aerosol-forming substrate 32. The volume limiting element 6 is activated or activatable by irradiation with infra-red radiation to either reduce or maintain its volume, and to thereby limit the overall expansion of the second portion 31*b* and hence the article 31, upon heating thereof.

Figure 14:
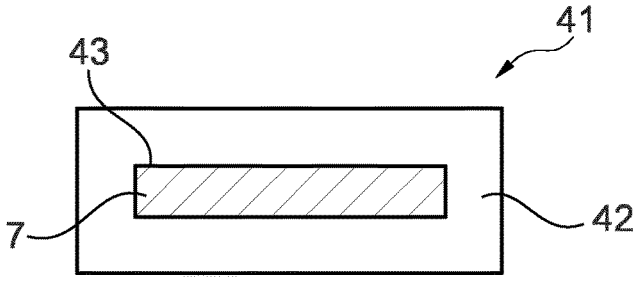
FIG. 14 is a cross-sectional view of an article for forming aerosol according to a further embodiment of the invention, prior to use of the article in a device for generating an aerosol.
Figure 15:
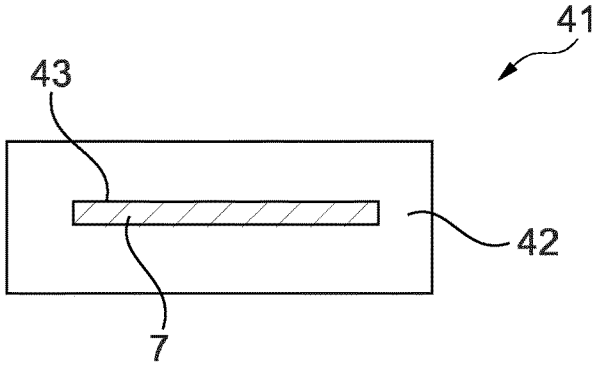
FIG. 15 is a cross-sectional view of the article shown in FIG. 14 subsequent to use of the article in a device for generating an aerosol.

Referring now to FIGS. 14 and 15, there is shown an article 41 for forming an aerosol according to a further embodiment of the invention in which like features to those described in respect of the article 1 shown in FIG. 4 are denoted by like references preceded by a '4' and will not be described further herein. The article 41 differs from that shown in FIG. 4 in that the volume limiting means 43 comprises an element 7 about which the aerosol-forming substrate 42 and carrier material are disposed. The element 7 is configured to reduce in volume when exposed to infra-red radiation, in use. In some embodiments the element 7 may comprise a susceptor or metallic element. The susceptor or metallic element may be operable to heat up when exposed, in use, to a magnetic field. Heating of the susceptor or metallic element may cause the element 7 (e.g. the susceptor or metallic element) to reduce in volume. For example, the susceptor or metallic element may comprise a shape memory material. The volume of the article 41 is thereby limited by such activation of the volume limiting means 43. Although the element is shown as being surrounded by the aerosol-forming substrate 42 and carrier material this need not be the case, and in embodiments the element 7 may be located at or adjacent a side and/or edge of the article.

While each of articles 1, 11, 21, 31, 41, 111 are described as comprising a single type of volume limiting means 3, 13, 23, 33, 43, 113 this need not be the case and, instead, any of the articles 1, 11, 21, 31, 41, 111 may additionally or alternatively comprise any of the other volume limiting means 3, 13, 23, 33, 43, 113 (where suitable).

While the articles 1, 11, 21, 31, 41, 111 are described as comprising aerosol-forming substrate 2, 12, 22, 32, 42, 112 comprising tobacco this need not be the case and, additionally or alternatively the aerosol-forming substrate 2, 12, 22, 32, 42, 112 may comprise any suitable material. Additionally or alternatively, whilst the aerosol-forming substrate 2, 22, 32, 42 of articles 1, 21, 31, 41 is described as comprising a powder this need not be the case and, instead, the aerosol-forming substrate 2, 22, 32, 42 may comprise any suitable form, fluid and/or solid (as described herein). Additionally or alternatively, whilst the articles 11, 111 are described as comprising aerosol-forming substrate 12, 112 comprising a reticulated open-celled foam this need not be the case and, instead, the aerosol-forming substrate 12, 112 may comprise a different type of foam and/or may comprise any other suitable form, fluid and/or solid, as described herein. Additionally or alternatively, the aerosol-forming substrate 12,112 of articles 11, 111 may be at least partially comprised or retained in a carrier material (for example as described herein). While articles 1, 21, 31, 41 are described as comprising a carrier material throughout which the aerosol-forming substrate 2 is deposited this need not be the case and, instead, the aerosol-forming substrate 2, 22, 32, 42 may be located at any suitable position of the carrier material (for example at the surface thereof, as described herein). Additionally or alternatively, the carrier material of articles 1, 21, 31, 41 may comprise any suitable structure (as described herein).

While the volume limiting means 3, 13, 23, 33, 43, 113 of the articles 1, 11, 21, 31, 41, 111 is described as being activated during heating of the aerosol-forming substrate 2, 12, 22, 32, 42, 112 to release volatile compounds at a temperature T1 this need not be the case and, instead, the volume limiting means 3, 13, 23, 33, 43, 113 may be activated at a greater temperature than that required to release volatile compounds from the aerosol-forming substrate 2, 12, 22, 32, 42, 112. For example, the volume limiting means 3, 13, 23, 33, 43, 113 may be heated to a temperature T2, which may be greater than the temperature T1 necessary to release volatile compounds from the aerosol-forming substrate 2, 12, 22, 32, 42, 112. Temperature T2 may be applied to the article 1, 11, 21, 31, 41, 111 prior to or subsequent to application to the article 1, 11, 21, 31, 41, 111 of temperature T1. Temperature T2 may comprise an 'over-temperature' which may be configured to occur after a predetermined time period or after a predetermined number of cycles of a device for generating an aerosol. Where a predetermined time period is used this may, for example, comprise a time interval after insertion of the article 1, 11, 21, 31, 41, 111 into a heating chamber of a device for generating an aerosol and/or a time interval after initiating a first or any subsequent heating of the article 1, 11, 21, 31, 41, 111.

The schematic drawings are not necessarily to scale and are presented for purposes of illustration and not limitation. The drawings depict one or more aspects described in this disclosure. However, it will be understood that other aspects not depicted in the drawings fall within the scope of this disclosure.

The invention claimed is:

1. An article for forming an aerosol, the article being insertable, in use, into a heating chamber of a device for generating an aerosol, the article comprising an aerosol-forming substrate and volume limiting means, the volume limiting means being activated or activatable by the device for generating an aerosol to limit the volume of the article;

wherein the article has a first volume prior to activation of the volume limiting means, and activation of the volume limiting means limits the article to a second volume, the second volume is less than or substantially equal to the first volume.

2. Article according to claim 1, wherein the volume limiting means is activated or activatable by irradiation with electromagnetic radiation from the device for generating an aerosol.

3. Article according to claim 1, wherein the volume limiting means is activated or activatable by application thereto of electrical energy from the device for generating an aerosol.

4. Article according to claim 1, wherein the article is at least partially formed from a resilient material.

5. Article according to claim 4, wherein the resilient material is a matrix material.

6. Article according to claim 5, wherein the matrix material is a foam.

7. Article according to claim 4, wherein the volume limiting means comprises the resilient material.

8. Article according to claim 1, wherein the volume limiting means comprises at least a peripheral portion of the article.

9. Article according to claim 8, wherein the volume limiting means comprises a cover layer of the article.

10. Article according to claim 1, wherein the volume limiting means comprises at least one cavity in the article.

11. Article according to claim 1, wherein the aerosol-forming substrate comprises the volume limiting means.

12. A method of using an article for forming an aerosol, the method comprising: providing an article comprising an aerosol-forming substrate and a volume limiting means; inserting the article into a heating chamber of a device for generating an aerosol; and activating the volume limiting means using the device for generating an aerosol to thereby limit the volume of the article;

wherein the article has a first volume prior to activation of the volume limiting means, and activation of the volume limiting means limits the article to a second volume, and, wherein the second volume is less than or substantially equal to the first volume.

13. An article for forming an aerosol, the article being insertable, in use, into a heating chamber of a device for generating an aerosol, the article comprising an aerosol-forming substrate and volume limiting means, the volume limiting means being activated or activatable by a device for generating an aerosol to limit the volume of the article;

wherein the article has a first volume prior to activation of the volume limiting means, and activation of the volume limiting means limits the article to a second volume, and the second volume is less than or substantially equal to the first volume;

wherein the volume limiting means is activated or activatable by irradiation with electromagnetic radiation from the device for generating an aerosol.

* * * * *